United States Patent [19]

Janson

[11] 4,153,543

[45] May 8, 1979

[54] FRACTIONATING APPARATUS

[76] Inventor: Bengt G. Janson, 31 Woodbridge Ter., South Hadley, Mass. 01075

[21] Appl. No.: 855,619

[22] Filed: Nov. 29, 1977

[30] Foreign Application Priority Data

Nov. 30, 1976 [SE] Sweden ..... 7613410

[51] Int. Cl.[2] ..... B07B 1/04

[52] U.S. Cl. ..... 209/250; 209/273

[58] Field of Search ..... 209/250, 268, 352, 273, 209/359; 210/416 R

[56] References Cited

U.S. PATENT DOCUMENTS

| | | | |
|---|---|---|---|
| 3,789,978 | 2/1974 | Janson | 209/250 X |
| 3,935,109 | 1/1976 | Rundqvist et al. | 209/250 X |

*Primary Examiner*—Ralph J. Hill

*Attorney, Agent, or Firm*—Cushman, Darby & Cushman

[57] ABSTRACT

A fractionating apparatus for separating fine fibers from coarse fibers in water containing a certain amount of air. A spray nozzle is arranged in a vessel and directed towards a screening cloth incorporated as a part of the vessel walls and which, on its discharge side, is arranged for free runoff of the fine particles and the part of the liquid passing through the seal means to its discharge side, while coarse particles and the other part of the liquid is bounced off the inner side of the screening cloth and collected in the vessel to a predetermined liquid level maintained by allowing the liquid to depart through an outlet. A desired pressure difference is maintained across the sieve means. The vessel is closed with the exception of the places where the sieve means are situated and where the outlet is arranged. The outlet side of the sieve means is exposed to atmospheric pressure while its inlet side is acted on by the excess pressure prevailing, during operation, in the air space between the liquid surface in the vessel and the sieve means. The excess pressure is provided by the air released from the liquid when it is sprayed from the nozzle. The outlet from the vessel is situated at the lower portion of the vessel and is in communication via a passage with an overflow situated outside the vessel, said overflow being raisable and lowerable for regulating the excess pressure in the vessel.

5 Claims, 2 Drawing Figures

FRACTIONATING APPARATUS

Figure 1:
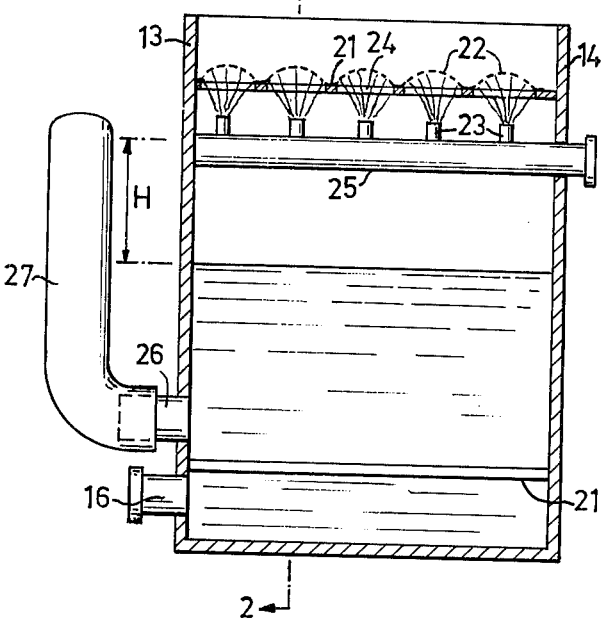

The present invention relates to a fractionating apparatus for separating fine particles from coarse particles.

An important area of use for such apparatus is the cellulose and paper industry, where it is of the greatest importance to recover fiber from pulp water and be able to reuse water to the greatest possible extent without deterioration in quality of the final product, while the water which is discharged to adjacent water courses should be as clean as possible and kept down to a small volume. Several known methods and apparatus are used to separate relatively coarse fibers in a coarse fraction and fine fibers, fiber fragments, filler and the like in a fine fraction from a fiber suspension. Not one of these known methods and apparatus pays special attention, however, to the problems which can arise due to the air which is usually entrained in the fiber suspension. The extent of these problems is explained more closely below.

Modern screening rooms and paper mills work with closed systems in which pressure screens are, inter alia, included. One of the desires in this respect is to avoid the admixture of air. In all new constructions of newspaper mills, deaerating systems are installed in combination with hydrocyclones for deaerating the fiber suspension. The deaerating systems are dimensioned for an air volume of 1–1.5%. These systems are relatively expensive however.

Air is present in three different forms in the fiber stock suspension:

(1) Free air or gas, which leaves the suspension if the latter is allowed to remain still for a sufficiently long time, is present as air bubbles in the free liquid surface, on the fibers and between the fibers. The amount of free air is to a great extent dependent on the type of pulp and the construction of the circulation system. A modern paper machine works with a stock suspension usually having an air content of 0.2–1%, which can attain 4–5%, on certain older machines.

(2) Entrapped air or gas in the form of small bubbles adhering to the water-repellant portions of the fibers and encapsulated in the capillaries of the fibers. The amount of entrapped air is usually 0.5–0.2% and depends to a large extent on the degree of beating. Increased beating should give a greater proportion of water-repellant surfaces to the fibers.

(3) Dissolved air or gas is what can be taken up by the water and the amount is dependent on pressure, temperature and pH.

The free air can, inter alia, give the following problems:

flotation effects;
foaming in the headbox and on the fourdrinier wire;
needle holes in the paper;
instability in the pipelines, screens, valves and pumps;
deteriorated drainage on the wire and filter.

The entrapped air can, inter alia, give the following problems:

increased drainage problems;
the fibers attract each other to form flock which can be difficult to break down;
increase in the capillarity of the paper;
formation on the wire is made worse, resulting in faults in the surface structure of the paper.

The dissolved air is generally no great problem, providing that it cannot turn into entrapped air, caused by pressure alterations, for example.

The severe air admixture which certain known methods and apparatus gives (a 20% increase in volume of fiber suspensions has been noted) is injurious in the conventional technique. In addition there is the bacteria-promoting effect of the air admixture in piping and apparatus as well as on paper machines and retrieving machines.

The object of the present invention is therefore to provide a fractionating apparatus using simple and cheap means to provide effective deaeration of the liquid, such as a fiber suspension, which is sprayed against the screening means, and which furthermore considerably lessens the admixture of air in the part of the liquid passing through the screening means together with finer particles, such as fine fibers in the case of fiber suspensions, while the remaining part of the liquid, together with coarser particles such as relatively coarse fibers, is turned away from the screening means.

In a preferred embodiment of the invention, at least one screening cloth is arranged substantially horizontally by it being fitted to the upper end of a closed vessel, said end being closed by a wall with an aperture for the screening cloth. Inside the vessel and below each screening cloth there is arranged a nozzle, to which is supplied a fiber suspension under pressure in a known way. The nozzle is suitably of the known construction for spraying liquid in the form of a complete cone of extremely finely divided liquid against the underside of the screening cloth. The cloth will thereby curve upwards under the action of the pressure from the liquid impinging on the cloth, and due to the difference in pressure prevailing between the air on either side of the cloth. In the air space on the runoff, or discharging side of the cloth, constant atmospheric pressure prevails. The liquid level in the vessel is adjustable to increase or decrease the free air space therein. The liquid in the closed vessel can depart through an outlet which, via a water trap connection, is connected to a raisable and lowerable overflow situated outside the closed vessel. When the apparatus is in operation, excess pressure in the air space of the closed vessel is obtained automatically, because the major portion of the air in the fiber suspension will leave the liquid when it is sprayed out from the nozzle in a finely divided form. When the liquid surface in the closed vessel is exposed to excess pressure, the liquid level will be lowered until the liquid in the passage to the overflow has risen to such an extent that the liquid begins to run over the overflow. The difference in levels between the overflow and the liquid level in the closed vessel thereby constitutes a measure of the excess pressure in the air space in the closed vessel. By raising or lowering the overflow it is thus possible to regulate the excess pressure in the closed vessel by extremely simple means, thereby controlling fractionation.

Runoff of liquid on the upwardly curved screen cloth can be done freely at the edges of the cloth, for collecting the liquid in an outer vessel in which the closed or inner vessel is arranged. The liquid level in the outer vessel is thereby adjusted to lie at a level with, or preferably at a very small height below that of the edge of the cloth. With this arrangement the liquid passing through the screening cloth, together with fine fibers and some air, will run down the sides of the upwardly curved screening cloth in the form of a thin liquid layer. Air from the inner vessel can thus pass practically freely through the thin liquid layer to merge with the surrounding atmosphere after the screening cloth. After running off from the screening cloth, the liquid is collected in the outer vessel. The liquid is thereby relieved of particles which can cause stoppage in the spray jets and the sealing water system and is also relieved from air in different forms, that could cause bacterial growth in piping and apparatus. Recovered fiber and good fragments can be returned to production.

The apparatus according to the invention thus enables effective deaeration by simple means of fiber suspensions, for example, and simple regulation of the pressure difference across the screening cloth.

A suitable embodiment of the apparatus according to the invention is shown schematically on the appended drawing.

Figure 2:
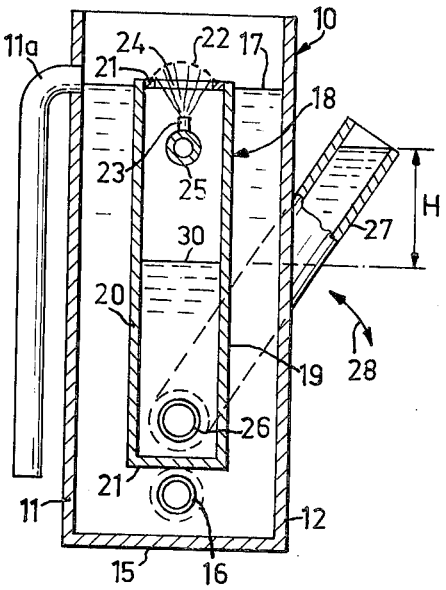

FIG. 1 is a schematic longitudinal section through an apparatus according to the invention, with an inner vessel arranged inside an outer vessel, and FIG. 2 is a schematic cross section along the line 2—2 in FIG. 1.

The outer vessel 10 has two side walls 11, 12, two end walls 13, 14 and a bottom 15, its upper end being open, or otherwise in communication with the ambient atmosphere. An outlet 16 is connected to the outer vessel, and is in communication in a known way with a discharge pump for keeping the liquid level 17 at a desired height.

In the embodiment shown, the inner vessel 18 is formed by two side walls 19, 20 and a bottom 21 sealingly joined to the end walls 13, 14 of the outer vessel. The inner vessel is closed at its upper end by means of an upper wall 21 having five apertures closed by means of screening cloths 22 in a structure known per se.

Under each screening cloth 22 there is arranged a jet nozzle 23 for spraying finely divided liquid such as water in the shape of a complete cone 24 directly upwards towards the underside of the appropriate screening cloth. The nozzles are arranged on a supply pipe 25, by which liquid with fine and coarse particles such as fine and coarse fibers is supplied to the nozzles under pressure. There is air in the fiber suspension, and the major portion of this air is released in a known way when the liquid is sprayed out in finely divided form towards the screening cloths. Since the inner vessel is closed, there is no other air in its air space than the air supplied from the liquid.

At the bottom of the closed or inner vessel there is an outlet 26 extending outwards outside the outer vessel and forming a journal for a pivotable upwardly directed discharge pipe 27. This pipe 27 can thus be positioned at different angles, as is indicated by the arrow 28 in FIG. 2.

The liquid can discharge at the upper end of the discharge pipe 27, the latter thus forming an overflow. By swinging the pipe 27 the overflow can thus be raised or lowered to a desired level. Other kinds of overflow which can be adjusted at different heights, can naturally be used.

At a certain height in the outer vessel there is arranged an outlet 11*a*, preventing the liquid level in the outer vessel to rise higher than the vicinity of the level of the upper wall 21 of the inner vessel, or the fastening edges of the screening cloths 22. It is thereby ensured that the discharge sides of the screening cloths are kept free and are only exposed to atmospheric pressure.

In operation, a state of continuity is obtained which varies within tight limits. When the liquid is finely divided or atomized by being sprayed out from the nozzles, the major portion of the air in the liquid will be released so that it is collected in the air space of the inner vessel. A portion of liquid containing fine particles passes through the upwardly curved screening cloths and runs off as a thin liquid layer on these and into the outer vessel, which is tapped via the outlet 16, while preferably retaining the liquid level 17 shown in FIG. 2.

The portion of the liquid which is deflected by the screening cloths will be collected in the inner vessel and forms a liquid level 30, the height of which is dependent on the excess pressure which can be built up in the inner vessel, in the air space between the water surface and the screening cloths. The size of this excess pressure can be regulated by adjusting the height of the overflow, i.e. by swinging the discharge pipe 27 to a desired position. The excess pressure acts on the liquid surface 30 in the inner vessel and is balanced by the liquid head H, which is the difference in height between the level of the overflow and the level of the liquid surface 30.

After the air has been released from the liquid in the air space pertaining to the inner vessel, this air will pass through the screening cloth and through the thin liquid layer running off from the discharge side of the screening cloth. Since the liquid layer can be kept relatively thin, practically no admixture of air in this liquid layer takes place, and the air departs substantially freely to the ambient atmosphere.

Practical trials have shown that the nature of the coarse fraction leaving the overflow varies notably even with comparatively small alterations of the excess pressure in the inner vessel. Increasing the height of the overflow by swinging up the discharge pipe 27 thus causes an increase of the excess pressure in the air space in the inner vessel, while lowering the overflow results in a reduction of the excess pressure in said air space. Regulation of the excess pressure can thus be carried out with extremely simple and cheap means, to provide desired pressure difference across the screening cloths.

What I claim is:

1. A fractionating apparatus for separating fine particles for coarse particles suspended in a liquid containing air comprising: a vessel having internally an upper air space communicating with a lower liquid space and being closed except for a top opening communicating with said air space and except for a liquid outlet communicating only with said liquid space; a spray nozzle located in said vessel and directed upwardly toward said top opening; means for supplying a suspension of fine and coarse particles in a liquid containing air to said nozzle whereby said nozzle discharges the suspension through said air space toward said top opening and causes air to be released from the suspension into said air space; horizontally arranged sieving means extending across said top opening for passing released air and a portion of the sprayed liquid and fine particles to the upper surface of said sieving means and for deflecting the remainder of the liquid and the coarse particles into said liquid space, the upper surface of said sieving means being exposed to substantially atmospheric pressure and being arranged to allow run-off of liquid and fine particles passing through said sieving means, and the lower surface of said sieving means being acted on by the pressure in said air space; and vertically adjustable overflow means connected to said liquid outlet for maintaining the liquid level in said vessel above the level of said liquid outlet and hence for regulating the pressure in said air space.

2. Apparatus as in claim 1 wherein said vessel is disposed within an outer vessel for collecting the liquid and fine particles which pass through said sieving means, the upper portion of said outer vessel being open to the atmosphere above the level of the collected liquid, said outer vessel having outlet means associated therewith for controlling the liquid level in said outer vessel at a level below said sieving means.

3. Apparatus as in claim 1 wherein said sieving means is flexible and assumes an upwardly convex shape under the action of the sprayed liquid and the action of the sprayed liquid and the action of the pressure in said air space.

4. Apparatus as in claim 1 wherein said outlet in said vessel includes a horizontal passage and wherein said vertically adjustable overflow means includes discharge pipe having a lower end connected to said horizontal passage and an upper open end and means mounting said discharge pipe for swinging movement such that said upper end can be raised and lowered.

5. A method of separating fine particles from coarse particles suspended in a liquid containing air comprising: spraying the suspension upwardly through a first air space in a vessel into contact with a horizontal sieve the upper surface of which is open to the atmosphere, so that a portion of the liquid and the fine particles pass through the sieve into a second air space outside the vessel and so that air is released from the sprayed liquid into the air space; collecting the remainder of the liquid and the coarse particles in the lower part of the vessel; withdrawing liquid from said vessel through an outlet which is in communication only with the liquid in said vessel; and regulating the superatmospheric pressure in said air space by maintaining the level of liquid above the level of said outlet.

* * * * *